US006564414B1

(12) United States Patent
Jamison

(10) Patent No.: US 6,564,414 B1
(45) Date of Patent: May 20, 2003

(54) PORTABLE RAMP WITH PAD

(76) Inventor: Donald Lester Jamison, 26 Deer Rd., Fawn Grove, PA (US) 17321

( * ) Notice: Subject to any disclaimer, the term of this patent is extended or adjusted under 35 U.S.C. 154(b) by 0 days.

(21) Appl. No.: 10/108,797

(22) Filed: Mar. 27, 2002

Related U.S. Application Data

(60) Provisional application No. 60/358,670, filed on Feb. 21, 2002.

(51) Int. Cl.[7] ..... E01D 1/00

(52) U.S. Cl. ..... 14/69.5

(58) Field of Search ..... 14/69.5; 254/88, 254/89 R; D34/32; 104/44

(56) References Cited

U.S. PATENT DOCUMENTS

| | | | | | |
|---|---|---|---|---|---|
| 2,720,036 | A | * | 10/1955 | Berger | 254/89 R |
| 3,875,672 | A | * | 4/1975 | Castoe | 104/44 |
| 4,050,403 | A | * | 9/1977 | Miller | 116/67 R |
| 4,341,371 | A | * | 7/1982 | Rotella | 14/69.5 |
| 4,480,389 | A | * | 11/1984 | Capovilla | 33/203.13 |
| 5,033,146 | A | * | 7/1991 | Fogarty et al. | 14/69.5 |
| 5,088,320 | A | * | 2/1992 | Fukuda et al. | 33/203.13 |
| 5,215,287 | A | * | 6/1993 | Leski | 254/122 |
| 5,324,004 | A | * | 6/1994 | Richardson | 254/88 |
| RE34,889 | E | * | 4/1995 | Fogarty et al. | 14/69.5 |
| 5,503,368 | A | * | 4/1996 | Torres | 254/122 |
| 5,781,954 | A | * | 7/1998 | Mayer | 14/69.5 |
| 5,855,359 | A | * | 1/1999 | Chipperfield | 254/122 |
| 5,946,756 | A | * | 9/1999 | Mapp | 14/69.5 |
| 6,045,122 | A | * | 4/2000 | Torres | 254/122 |
| 6,193,078 | B1 | * | 2/2001 | Stuhlmacher | 211/20 |
| 6,314,602 | B1 | * | 11/2001 | Wallen | 14/69.5 |

FOREIGN PATENT DOCUMENTS

| | | | | |
|---|---|---|---|---|
| GB | 2226997 | * | 7/1990 | B60S/9/02 |

* cited by examiner

*Primary Examiner*—Gary S. Hartmann
*Assistant Examiner*—Kristine Florio
(74) *Attorney, Agent, or Firm*—Bartlett & Sherer

(57) ABSTRACT

The Portable Ramp with Pad and Stabilizers makes it possible to turn your wheels right or left while your vehicle is on the ramps and get at work areas of your car or other vehicle that you may not get at easily with a conventional portable ramp. The Stabilizers on the ramp are to help with the flip problem which has happened with conventional ramps. The ramp is portable so you can move the ramp or take it with you to other worksites.

3 Claims, 4 Drawing Sheets

PORTABLE RAMP WITH PAD

This application claims the benefit of provisional application Ser. No. 60/358,670 filed Feb. 21, 2002.

SUMMARY OF THE INVENTION

The Ramp is portable so that it can be used at any location. The Ramp is constructed in such a way that it will allow the wheels to be turned when a car or other vehicle is pulled up on it. Two Ramps can be used and the front or back wheels of the vehicle can be pulled up on the Ramps and rest on the movable Pad on the Ramp. The Pad rests on bearings and rotates, so you can turn the wheels of the vehicle when it is on the Ramps. The fact that the Pad is on bearings even though the vehicle may be heavy permits easy turning of the wheels for easy access to work areas of the vehicle. The Ramp is contructed in such a way as to allow for the turning of the wheels and is not like some Ramps that you pull up on and can not turn your wheels. There are Stabilizer attached to the back and back sides of the Ramp to help keep it from flipping over on uneven surfices. The Pads are constructed in such a way that they can be removed and repaired if necessary. The Ramp and Pad are made of steel. The Ramp with Pad can be used to elevate the front or rear of vehicles to do maintenance work on them.

DETAILED DESCRIPTION

Figure 1:
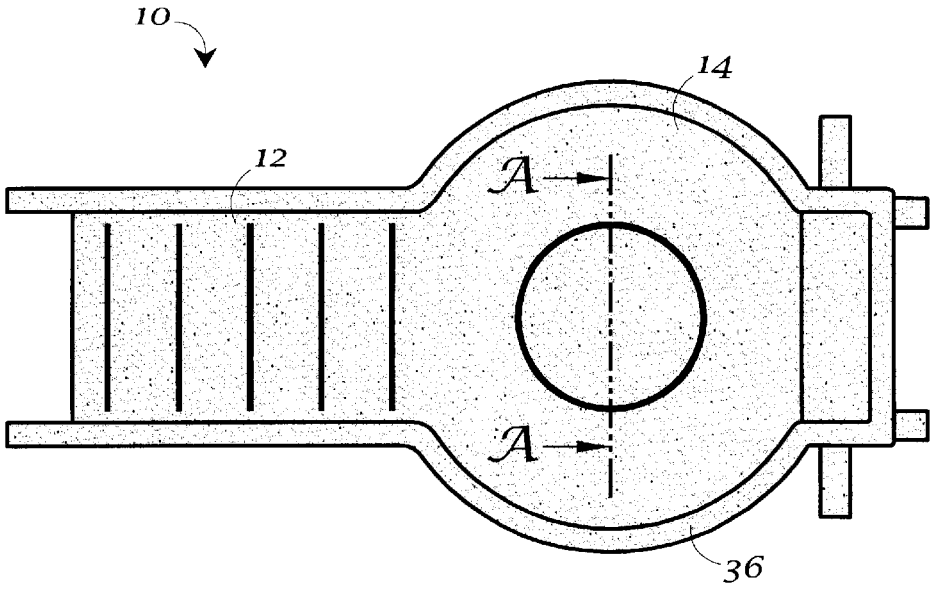
FIG. 1 is the top view of the Ramp with Pad with sides of bottom of Pad area closed.
Figure 2:
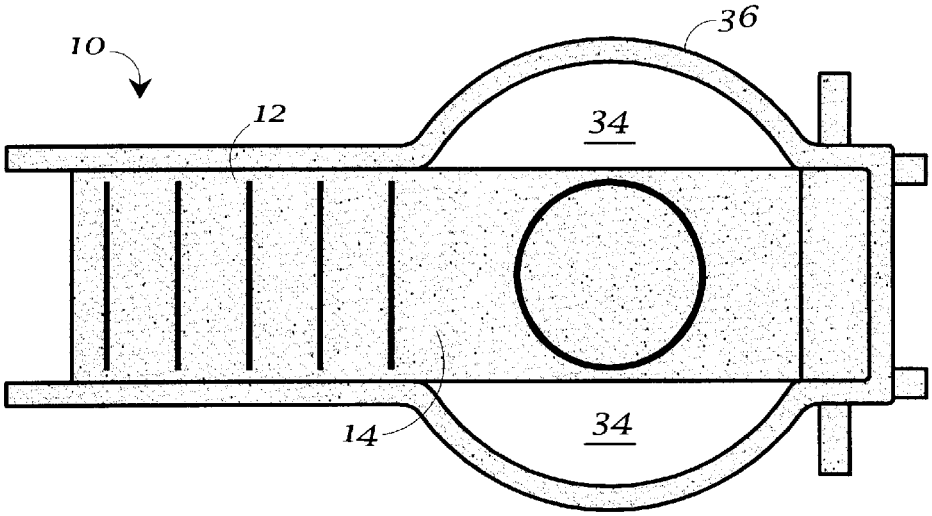
FIG. 2 is the top view of the Ramp with Pad with sides of bottom of Pad area open. Sides of bottom of Pad area can be open or closed as shown in FIGS. 1&2
Figure 3:
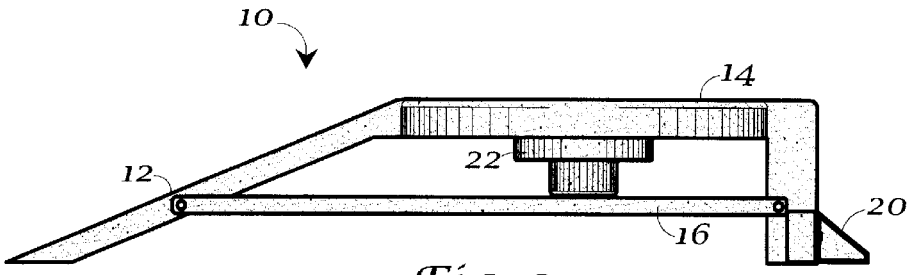
FIG. 3 is the side view of the Ramp with Pad looking at it from the right or left side.
Figure 4:
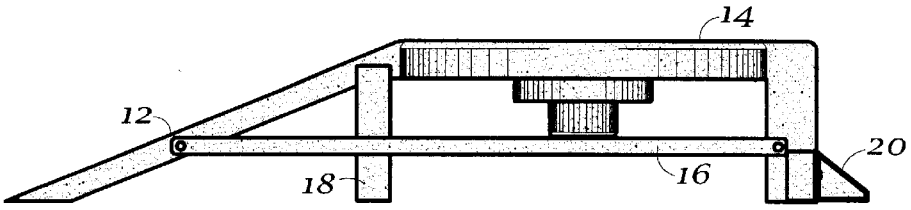
FIG. 4 is the side view of the Ramp with Pad showing it with a vertical brace looking at it from the right or left side.
Figure 5:
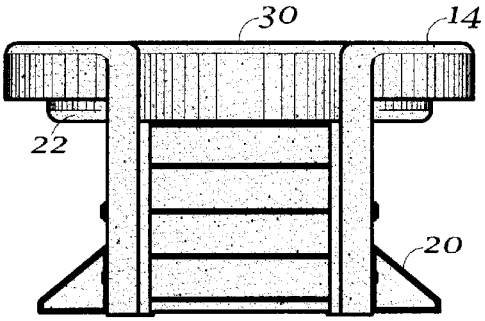
FIG. 5 is the front elevation of the Ramp as you would you would enter.
Figure 6:
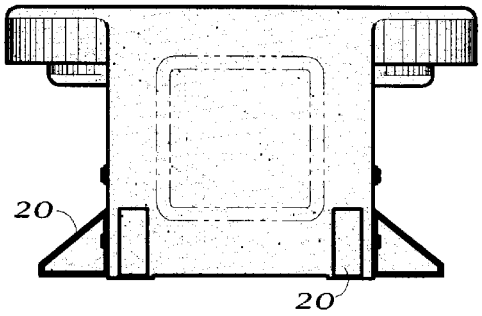
FIG. 6 is the back elevation of the Ramp showing the Stabilizers attached to the back and back sides of the Ramp to keep the Ramp Stable on uneven Surfaces.
Figure 7:
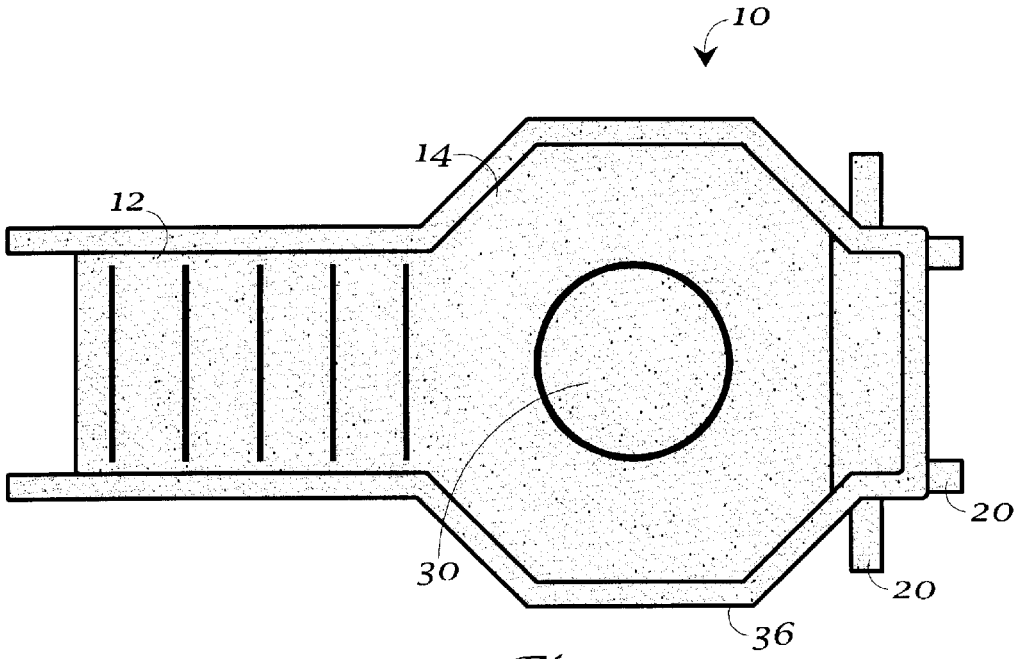
FIG. 7 is the top view of the Ramp and Pad using Charfered sides in the Pad area with the sides of the bottom of the Pad area closed. Sides of the bottom of Pad area can be open or closed as shown in FIGS. 7&8

As shown in FIGS. 1–8, each of the portable ramps 10 include an inclined portion 12 and a substantially horizontal portion 14. As shown, the ramp is not connected to any other structure so as to be readily movable to any desired location. The ramps may also include horizontal and/or vertical braces 16, 18 as shown In FIGS. 3 and 4, and may include horizontally extending stabilizers 20.

Figure 8:
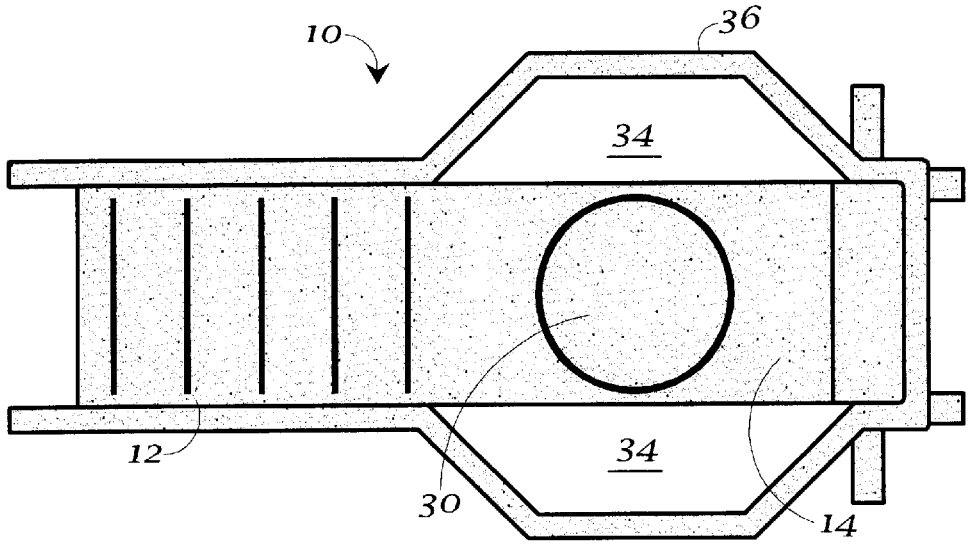
FIG. 8 is the top view of the Ramp and Pad using Charfered sides in the Pad area with the sides of the bottom of the Pad area open.
Figure 9:
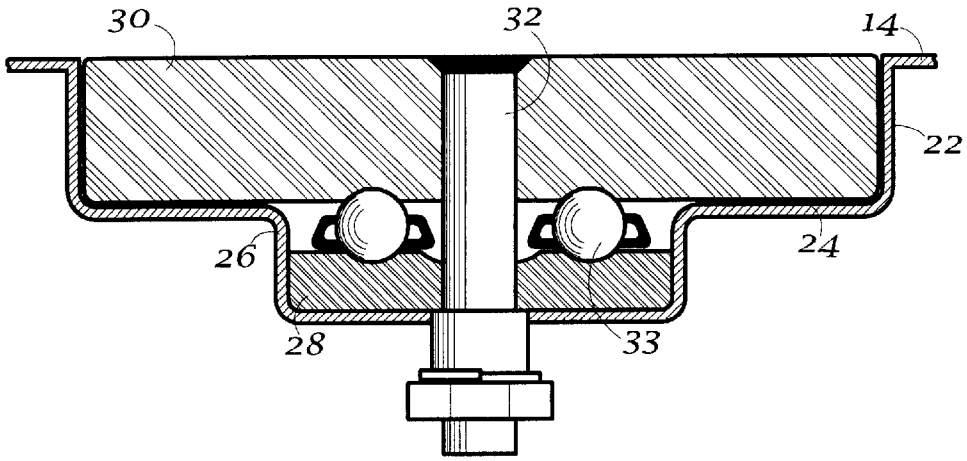
FIG. 9 is a view of the rotating pad which is shown in FIGS. 3&4

As shown in all of the figures, and with the most detail in FIG. 9, horizontal portion 14 includes a recessed well 22 having a horizontal surface 24, and a second recessed well 28 having a horizontal surface 28. A rotatable pad 30 is positioned in recessed well 22 so as to be rotatable about a vertical shaft 32. Also, the preferred embodiment includes a low friction element such as the illustrated bearings 33, and the embodiments of FIGS. 2 and 8 provide open spaces 34 between horizontal portions 14 and the surrounding frames 36.

From the foregoing it will be apparent that a person may easily move the portable ramps and position them so as to elevate the wheels of a vehicle such that the front wheels may be rotated about the axis of shaft 32 and thereby facilitate the work on the wheel. It will also be apparent that the foregoing description of one preferred embodiment is intended to be illustrative of the principles of the invention, and that the invention is not intended to be limited other than as set forth in the following claims interpreted under the Doctrine of Equivalents.

What is claimed is:

1. A portable ramp for raising the wheels of a vehicle off the ground comprising:

(a) a ramp having an inclined portion and a substantially horizontal portion;

(b) said ramp being unconnected to any other structure whereby said ramp is readily movable to any desired location;

(c) said horizontal portion having a first recessed well;

(d) a shaft extending vertically in said first recessed well;

(e) a rotatable pad mounted in said first recessed well to rotate about said vertical shaft so as to enable rotation of the wheels while on the ramp;

(f) a second recessed well below said first recessed well wherein said vertical shaft extends through said second recessed well; and (g) a low coefficient of friction means in said second recessed well for facilitating rotation of said pad.

2. The portable ramp of claim 1 wherein said well is circular.

3. The portable ramp of claim 2 wherein said pad is circular and of slightly smaller diameter than the diameter of said well.

* * * * *